US008607585B2

(12) United States Patent
Jang et al.

(10) Patent No.: US 8,607,585 B2
(45) Date of Patent: Dec. 17, 2013

(54) REFRIGERATOR

(75) Inventors: Heon-Jae Jang, Changwon (KR); Min-Bon Koo, Changwon (KR); Chang-Bong Choi, Changwon (KR); Youl Kwon, Changwon (KR)

(73) Assignee: LG Electronics Inc., Seoul (KR)

( * ) Notice: Subject to any disclaimer, the term of this patent is extended or adjusted under 35 U.S.C. 154(b) by 756 days.

(21) Appl. No.: 12/522,134

(22) PCT Filed: Jan. 2, 2008

(86) PCT No.: PCT/KR2008/000012

§ 371 (c)(1), (2), (4) Date: Aug. 3, 2009

(87) PCT Pub. No.: WO2008/082252

PCT Pub. Date: Jul. 10, 2008

(65) Prior Publication Data

US 2010/0071401 A1 Mar. 25, 2010

(30) Foreign Application Priority Data

| | | |
|---|---|---|
| Jan. 5, 2007 | (KR) | 10-2007-0001600 |
| Jan. 9, 2007 | (KR) | 10-2007-0002539 |
| Jan. 12, 2007 | (KR) | 10-2007-0003933 |
| Jan. 12, 2007 | (KR) | 10-2007-0003935 |

(51) Int. Cl.
*F25D 3/00* (2006.01)

(52) U.S. Cl.
USPC ..... 62/391; 62/389

(58) Field of Classification Search
USPC ..... 62/389, 344, 391, 398, 434, 438, 267; 222/167; 312/349, 350, 405.1, 334.1; 24/295, 293, 294
See application file for complete search history.

(56) References Cited

U.S. PATENT DOCUMENTS

| | | | | |
|---|---|---|---|---|
| 5,944,338 | A * | 8/1999 | Simpson | 280/650 |
| 6,317,937 | B1 * | 11/2001 | Ishihara et al. | 24/297 |
| 2002/0089274 | A1 * | 7/2002 | Liang et al. | 312/334.44 |
| 2004/0182103 | A1 * | 9/2004 | Jung | 62/389 |
| 2004/0183414 | A1 * | 9/2004 | Kwon | 312/401 |
| 2004/0217023 | A1 * | 11/2004 | Fagg et al. | 206/242 |
| 2005/0268638 | A1 | 12/2005 | Voglewede et al. | |
| 2005/0268639 | A1 * | 12/2005 | Hortin et al. | 62/389 |
| 2006/0250059 | A1 * | 11/2006 | Lemm | 312/331 |
| 2009/0007585 | A1 * | 1/2009 | Kim et al. | 62/353 |
| 2009/0095010 | A1 * | 4/2009 | Moon | 62/391 |

FOREIGN PATENT DOCUMENTS

| | | | |
|---|---|---|---|
| CN | 1690621 | A | 11/2005 |
| CN | 1699872 | A | 11/2005 |
| CN | 1707205 | A | 12/2005 |
| KR | 1998-066100 | A | 10/1998 |
| KR | 1998-083723 | A | 12/1998 |
| KR | 1998083723 | * | 6/1999 |
| KR | 10-2004-0015666 | A | 2/2004 |
| KR | 10-2005-0077581 | A | 8/2005 |
| KR | 1020040005424 | * | 10/2005 |
| WO | WO 2006/092774 | * | 3/2005 |

* cited by examiner

*Primary Examiner* — Allana Lewin
*Assistant Examiner* — Dawit Muluneh
(74) *Attorney, Agent, or Firm* — Birch, Stewart, Kolasch & Birch, LLP

(57) ABSTRACT

Disclosed related to a refrigerator according to the present invention comprising a main body in which a cold air storage is provided; a door connected to the main body; a dispenser assembly mounted on the door; and a tray assembly selectively protrudably connected to the dispenser assembly therefrom in a front direction.

11 Claims, 8 Drawing Sheets

REFRIGERATOR

TECHNICAL FIELD

This document relates to a dispenser assembly of a refrigerator.

BACKGROUND ART

Generally, refrigerators are home appliances for refrigerating or freezing foods in order to store the foods for a long time, in which refrigeration cycle is operated by electric components provided therein and a storage space inside of the refrigerators is cooled by directly/indirectly using cold air generated from the refrigeration cycle.

Now, these refrigerators are in a trend of bigger size and multi-function according to an improved diet and various tastes of users, and equipments such as a home-bar and a dispenser for supplying ice and water to a door of the refrigerators are provided in the refrigerators to offer convenience to the users.

The dispenser of the equipments is to dispense purified water to the outside, and it is configured to dispense purified water by placing a vessel where the water comes out.

This dispenser has an advantage in that it is possible to easily dispense the water without opening the refrigerator door, since the dispenser is attached to a front face of the refrigerator door.

Meanwhile, this dispenser should be rigidly attached to the refrigerator door, and there is a need to have a remaining water collecting structure for collecting remaining water, which is dropped downward therefrom in the process of taking out water.

DISCLOSURE OF INVENTION

Technical Problem

An object of the present invention is to provide a dispenser assembly and a tray assembly which allow to receive water or ice by using vessels of various size.

Also, another object of the present invention is to provide a dispenser assembly and a tray assembly which allow to remove remaining water, which is generated by taking out water or ice.

Also, further another object of the present invention is to provide an assembly structure which is capable of simplifying an assembly process of the dispenser assembly and preventing elements from being damaged.

Technical Solution

A refrigerator according to the present invention to achieve the above-mentioned objects comprises a main body in which a cold air storage is provided; a door connected to the main body; a dispenser assembly mounted on the door; and a tray assembly selectively and protrudably connected to the dispenser assembly therefrom in a front direction.

A refrigerator according to another aspect of the present invention comprises a dispenser assembly for dispensing water or ice; a door provided with a recess for seating the dispenser assembly at a front surface thereof; a tray assembly drawably connected to a bottom of the dispenser assembly; and a guide member guiding the tray assembly to be drawn.

A refrigerator according to further another aspect of the present invention comprises a dispenser assembly; a tray assembly provided in the dispenser assembly, the tray assembly including a tray body having a remaining water storage therein, and a tray cover in which an opening for draining water is formed; and a door of which the dispenser assembly is mounted on the front surface.

A refrigerator according to further another aspect of the present invention comprises a door blocking a cold air storage space; a dispenser assembly provided in the front surface of the door and dispensing water or ice; and a tray rotatably provided at a bottom surface of the dispenser assembly and possible to be protruded in a forward direction.

A refrigerator according to further another aspect of the present invention comprises a door opening/closing a refrigerating chamber or a freezing chamber; a dispenser assembly mounted on a front surface of the door and provided with a tray seating portion on a bottom; and a tray seated on the tray seating portion, wherein a guide rib is protruded on one of a side surface of the tray seating portion or a side surface of the tray, and a guide slit in which the guide rib is received is formed in the other.

A refrigerator according to further another aspect of the present invention comprises a dispenser assembly including a dispenser housing in which a vessel-receiving space is formed, and a fastening projection protruded to a rear surface of the dispenser housing; a door provided with a receiving portion for receiving the dispenser assembly, and an engagement hole provided in an edge of the receiving portion; and an engagement element inserted into the engagement hole at a state that the engagement element is hooked to the fastening projection.

Advantageous Effects

The refrigerator according to the present invention to achieve the above-mentioned objects has an advantageous effect in that the tray assembly stably supports the vessel of big size because the tray assembly is drawably slid in a front direction.

Also, the refrigerator according to the present invention has an advantageous effect in that the drainage of the remaining water is easily accomplished, because the remaining water storage is provided in the tray assembly and the tray assembly can be disassembled.

Also, the refrigerator according to the present invention has an advantageous effect in that it is easy to clean the bottoms of the tray assembly and the dispenser assembly, because the tray assembly can be disassembled.

Also, the refrigerator according to the present invention has an advantageous effect in that the engagement portion is protected from being damaged when the dispenser assembly is fastened to the door, since the engagement portion according to the embodiment of the present invention is applied.

Also, the refrigerator according to the present invention has an advantageous effect in that there is no need to use a separate engagement tool such as a driver, since the engagement is accomplished by simply inserting the dispenser assembly in a state that the engagement element is fastened to the dispenser assembly. Furthermore, there is an advantageous effect in that the manufacturing process is simplified by this assembly process.

MODE FOR THE INVENTION

Hereinafter, the present invention will be described in more detail with respect to preferred embodiments thereof in conjunction with the accompanying drawings. Here, it will be understood that the invention is not limited to the details described thereof. Therefore, it is possible to propose another embodiment, in which various substitutions and modifications are intended to be embraced within the scope of the invention, by way of substitutions, modifications and abbreviations.

Figure 1:
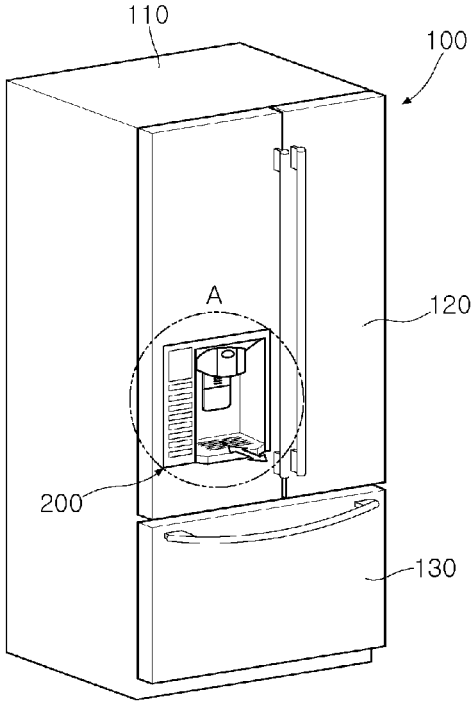
FIG. 1 is a perspective view showing an external appearance of a refrigerator according to an embodiment of the present invention.
Figure 2:
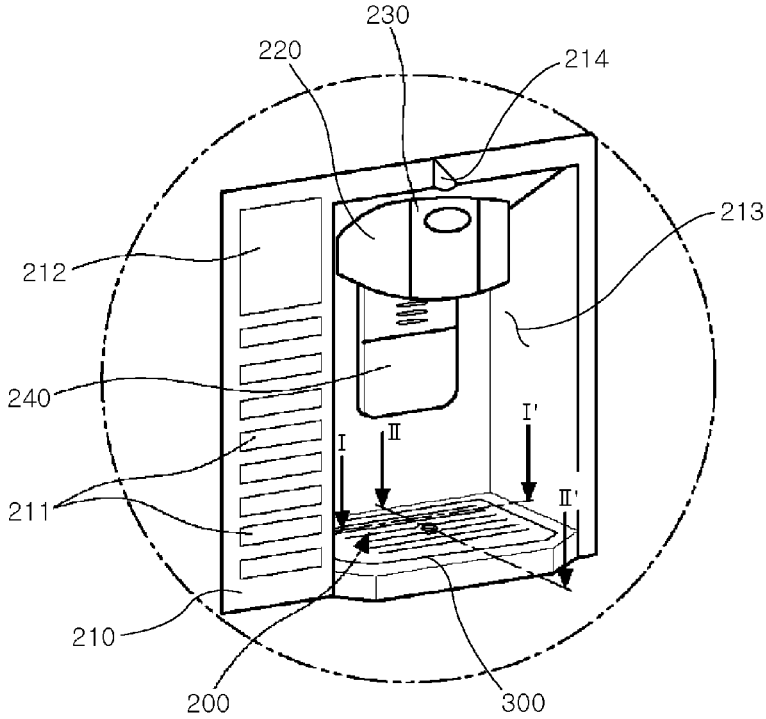
FIG. 2 is an enlarged view showing a dispenser assembly mounted in a refrigerator.

FIG. 1 shows an external appearance of a refrigerator according to an embodiment of the present invention, and FIG. 2 shows a dispenser assembly to be attached to the refrigerator.

Referring to FIGS. 1 and 2, a refrigerator 100 according to an embodiment of the present invention includes a main body 110, a door 120 rotatably connected to a front surface of the main body 110 and a freezing chamber drawer 130 drawably provided in the main body 110. Further, the main body 110 is formed as a rectangular profile, of which a front surface is open, to make a storage space for storing foods therein.

The storage space of the main body 110 is partitioned into a refrigerating chamber and a freezing chamber in an up and down direction, and therefore the foods may be stored in the refrigerating chamber or the freezing chamber depending on the storage condition. Further, a temperature of the refrigerating and freezing chambers is properly maintained by controlling a flow of cold air supplied into the refrigerating and freezing chambers.

Meanwhile, the refrigerating chamber formed in the main body 110 is selectively closed by the door 120. Further, the freezing chamber is formed at a lower side of the refrigerating chamber, and the freezing chamber drawer 130 which is horizontally drawable is provided therein. In particular, the freezing chamber drawer 130 includes a freezing box accommodated in the freezing chamber, and a freezing chamber door coupled to a front surface of the freezing box. Furthermore, the user may store or take out foods by drawing the freezing chamber drawer toward the front.

A dispenser assembly 200 for supplying ice or water is provided on a front surface of the door 120. The dispenser assembly 200 serves to dispense water or ice at the outside, which is purified/manufactured in the main body 110, and a portion of the dispenser assembly is depressed into the door 120.

Particularly, the dispenser assembly 200 includes a housing 210 inserted into a front surface of the door 120, an ice chute 220 guiding the ice, a dispensing switch 240 for dispensing ice and a dispensing button 230 for dispensing water.

More particularly, a vessel-receiving recess 213 which is depressed backward is formed in the housing 210, and the ice chute 220 is extended from the upper surface of the vessel-receiving recess 213 to the lower part. Further, the dispensing button 230 for dispensing water is provided on the front surface of the ice chute 220, and a water-dispensing hole 214 is formed at the upper side of the dispensing button 230. Therefore, the water is dispensed from the water-dispensing hole 214 when the user presses the dispensing button 230 with a cup.

Also, the dispensing switch 240 for dispensing ice is provided on the inner-circumferential surface of the vessel-receiving recess 213. Particularly, the ice is dropped through the ice chute 220 when the user presses the dispensing switch 240 with an ice vessel.

Also, a tray assembly 300 for seating the vessel is provided on the bottom of the housing 210. Particularly, the tray assembly 300 accomplishes a function of receiving remaining water to accommodate remaining water or splinters of ice as well as a function of supporting the vessel, and the structure of the function of receiving remaining water will be described.

Also, a plurality of operating buttons 211 for operating the entire refrigerator including the dispenser assembly 200 are provided on the side the dispenser assembly 200, i.e. the side surface of the housing 210, and a display 212 in which the operational state of the refrigerator is displayed is further provided on one side of the operating buttons 211.

Figure 3:
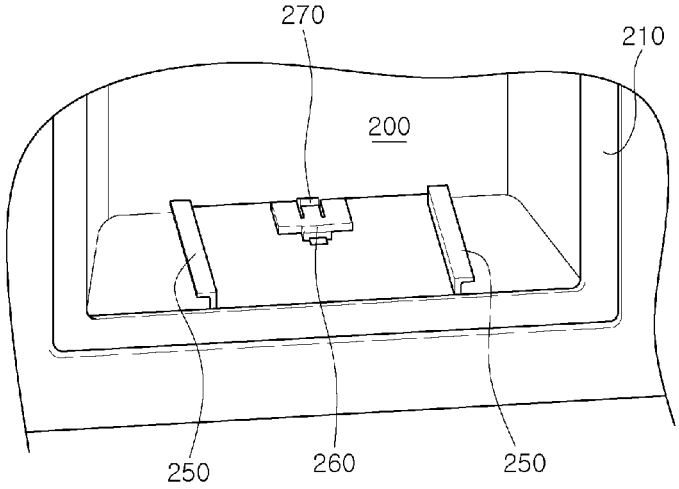
FIG. 3 is a perspective view partly showing a bottom surface of a dispenser housing constituting a dispenser assembly according to an embodiment of the present invention.

FIG. 3 shows a bottom of a dispenser housing constituting a dispenser assembly according to an embodiment of the present invention.

Referring to FIG. 3, a bottom of the dispenser housing 210 constituting the dispenser assembly 210 is formed as a flat profile depressed into the inside. Further, a pair of guide rails 250 are symmetrically formed on the bottom of the dispenser housing 210.

Particularly, the guide rails 250 are to guide the entrance/exit of the tray assembly 330, they are extended long enough from the front to the rear of the bottom of the dispenser housing 210. Further, the cross section of the guide rails 250 is bent to have a 'ㄱ' profile.

That is, the pair of guide rails 250 extend upward at a predetermined length, and then, they are bent and extended in the opposite direction. Therefore, a space is formed by a vertical part and horizontal part of the guide rails 250, and slide rails 360 of the tray assembly 300 is inserted along the space.

The pair of guide rails 250 are formed at a specific interval, and a supporting structure is provided in the separated space. Further, the supporting structure is formed on the bottom of the dispenser housing 210.

Particularly, the supporting structure is composed of a fixture 270 for stably fixing the tray assembly 300 to the housing 210, and a limiter 260 for restricting the drawing limit of the tray assembly 300.

The fixture 270 interferes with a hooking element 380 (see FIG. 5) of the tray assembly 300, so that the tray assembly 300 is stably mounted on the housing 210. Further, a top of the fixture may be formed as a round projection or a slanted projection. Furthermore, if the hooking element 380 is detached from the fixture 270, the tray assembly 300 can be separated from the dispenser assembly 200.

Meanwhile, the limiter 260 is formed at a point where it is separated from the fixture 270 to the front at a specific interval.

Particularly, the limiter 260 protrudes upward, and thus, it serves to set the drawing limit of the tray assembly 300. That is, the draw of the tray assembly 300 is limited, since the hooking element 380 extended to the rear end of the bottom of the tray assembly 300 engages with the limiter 260. This will be described with reference to the drawings.

Here, the fixture 270 and the hooking element 380 may be formed as shapes, which joints to each other, for example a hook shape. Further, the engagement between the fixture 270 and the hooking element 380 can be released when the tray assembly 300 is drew.

Figure 4:
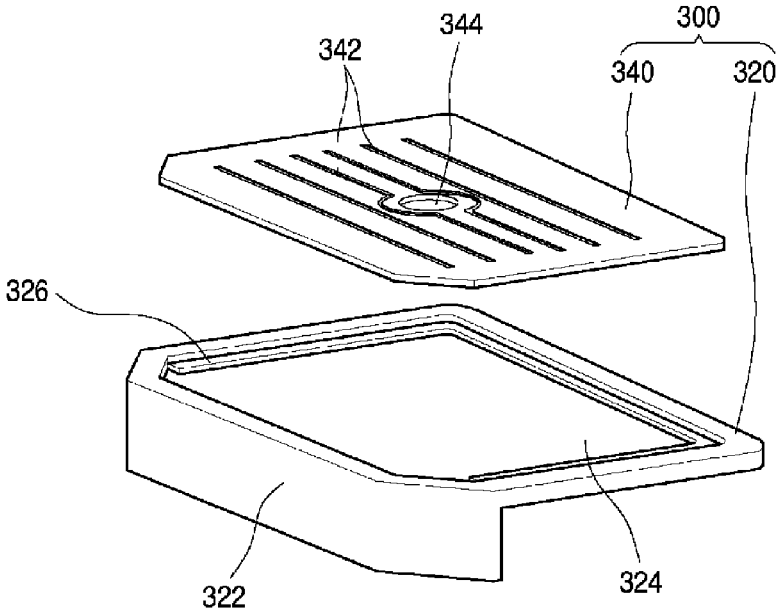
FIG. 4 is an exploded perspective view showing a tray assembly of a refrigerator according to an embodiment of the present invention.

FIG. 4 shows a tray assembly of a refrigerator according to an embodiment of the present invention.

Referring to FIG. 4, the tray assembly 300 includes a tray body 320 and a tray cover 340.

Particularly, the tray body 320 forms overall external appearance of the tray assembly 300 and receives the remaining water due to the water-dispensing process through the dispenser assembly 200.

A knob 322 is formed on the front end of the tray body 320. The knob 322 forms the external appearance of the front surface of the tray body 320. Further, the knob is extended from the front end of the tray body 320 to lower part, so that the user easily grips it while drawing/pushing the tray assembly 300.

Meanwhile, a remaining water storage 324, which is depressed inward at a predetermined depth to store the remaining water, is formed in the inner side of the tray body 320. The remaining water storage 324 is formed to have an area corresponding to the shape of the tray cover 340, and an upper side opening of the remaining water storage is covered by the tray cover 340.

Further, a seating portion 326 for seating the tray cover 340 is formed on the inner-circumferential surface of the tray body 320. The seating portion 326 supports a bottom edge of the tray cover 340 when the tray cover 340 is seated thereon. Furthermore, the seating portion 326 is surrounded at a point corresponding to a thickness of the tray cover 340 from the upper surface to the lower part of the tray body 320. Therefore, the upper surface of the tray body 320 and the upper surface of the tray cover 340 are at the same height when the tray cover 340 is seated. Further, the water dropped from the water-dispensing hole 214 is collected into the remaining water storage 324, as a plurality of through-holes 342 are formed on the tray cover 340.

Particularly, the through-hole 342 may be formed by horizontally or longitudinally slitting it with respect to the external appearance, or the through-hole 342 may be formed as a plurality of drilled-holes.

Also, a knob hole 344 is formed at the approximate center of the tray cover 340. The user's finger is inserted into the knob hole 344 when detaching/attaching the tray cover 340, and thus, the knob hole is drilled and formed as a round hole to have a size corresponding to the size of the user's finger, so that the user may insert his/her finger therein.

Meanwhile, the tray cover 340 may be made of metallic materials such as a stainless steel or an aluminum to enhance the external appearance, and the tray body 320 may be made of plastic materials to mold it with ease.

Figure 5:
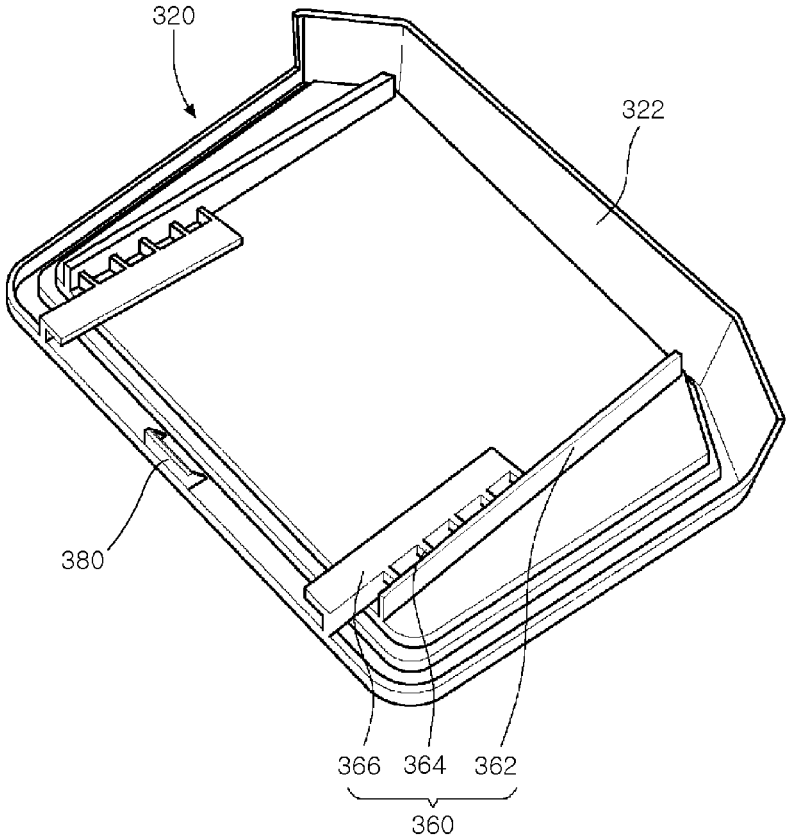
FIG. 5 is a bottom perspective view showing a tray assembly of a refrigerator according to an embodiment of the present invention.

FIG. 5 shows a bottom of a tray assembly of a refrigerator according to an embodiment of the present invention.

Referring to FIG. 5, the slide rails 360 are formed on the bottom of the tray assembly, more particularly, on both sides in the bottom of the tray body 320. The slide rails 360 are configured to be inserted into the guide rails 250, as described in the above. That is, they are configured to backwardly/forwardly guide the entrance/exit of the tray assembly 300, and they are formed as a shape capable of being accommodated in the guide rails 250.

More particularly, the slide rails 360 include a guide rib 362, a supporting portion 364 and a sliding portion 366.

The guide rib 362 is extended forward/backward along the bottom of the tray body 320, and the pair of guide ribs 362 are provided in both sides of the tray body. Further, the lower end of the guide rib 362 contacts with the bottom of the dispenser assembly 200. That is, the lower end of the guide rib 362 slides on the bottom of the dispenser assembly 200, with they cling together, when the tray assembly 300 is drew/pushed. Therefore, the shake due to the entrance/exit of the tray assembly 300 is prevented, and this prevents the slide rails 360 from being derailed from the guide rails 250.

Further, the supporting portion 364 connects the guide rib 362 with the sliding portion 366 and prevents the slide rails 360 from being damaged due to eccentricity of the tray assembly 300 while drawing/pushing the tray assembly 300. In addition, the supporting portion 364 serves to stably support the tray assembly 300 against the moment caused by weight of the vessel, when the tray assembly 300 is fully drew.

Also, the sliding portion 366 is bent as the same shape as the cross-sectional shape of the guide rails 250. Therefore, a horizontal bent portion of the sliding portion 366 and a horizontal bent portion of the guide rails 250 slide together in a state that they contact to each other.

Meanwhile, a hooking element 380 protruded downward is formed on the rear end of the tray body 320. The hooking element 380 is to fixedly mount and draw the tray assembly 300, and it is protruded from the lower surface of the tray body 320 to downward so that one of it's surfaces is a slanted surface.

Therefore, the tray assembly 300 is fixedly mounted by fastening the tray assembly 300 onto the fixture 270 when mounting it.

Also, the tray assembly 300 is not derailed therefrom, since the hooking element 380 is fastened onto the limiter 260 when the tray assembly 300 is fully drew. However, the fastening is released when a force of a predetermined level and more is applied thereto, because of the shapes of the hooking element 380, the fixture 270 and the limiter 260. Therefore, it is possible to separate the tray assembly 300 from the dispenser assembly 200 in order to clean the tray assembly 300 and remove the remaining water.

Figure 6:
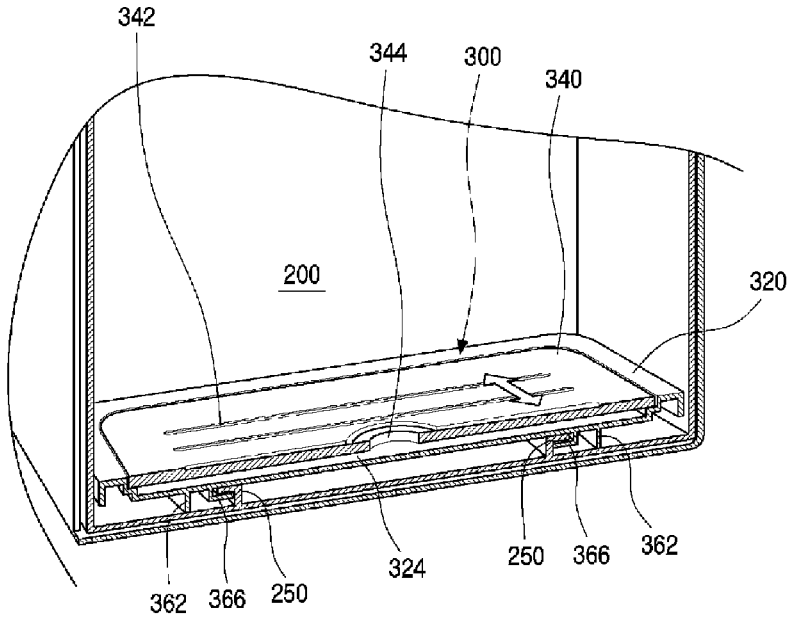
FIG. 6 is a cross-sectional view of line I-I' in FIG. 2.
Figure 7:
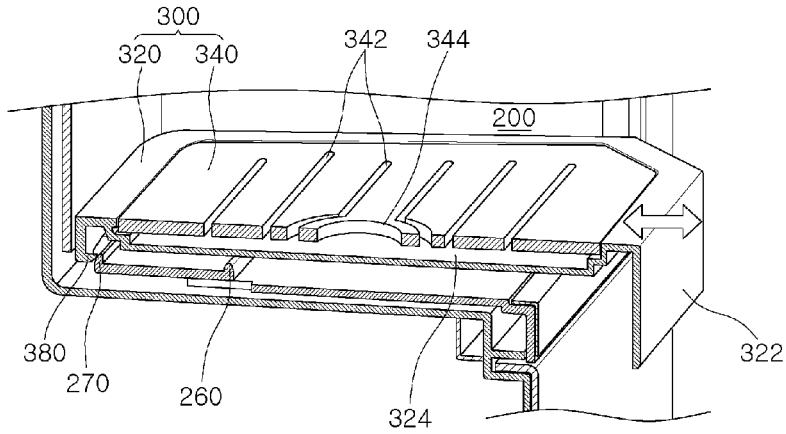
FIG. 7 is a cross-sectional view of line II-II' in FIG. 2.
Figure 8:
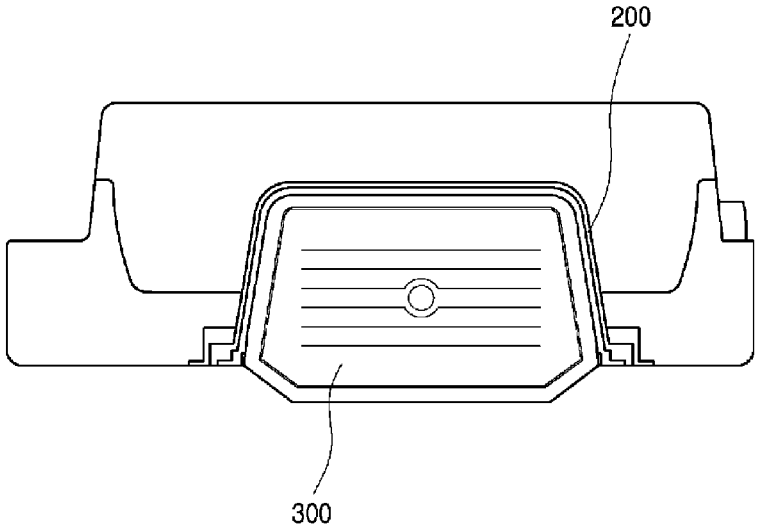
FIGS. 8 and 9 are state diagrams showing operational state of a tray assembly.
Figure 9:
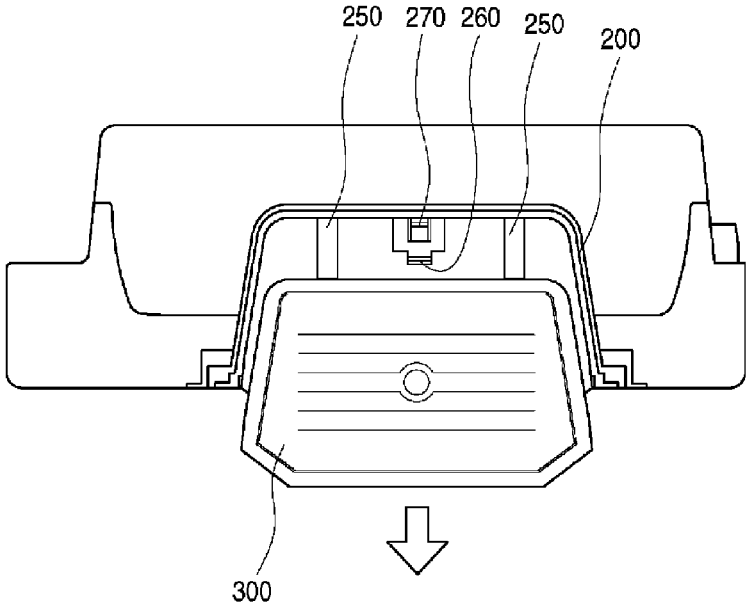

FIG. 6 shows a cross section of line I-I' in FIG. 2, FIG. 7 shows a cross section of line II-II' in FIG. 2, and FIGS. 8 and 9 show an operational state of a tray assembly.

Referring to FIGS. 6 to 9, the guide rails 250 formed on the bottom of the dispenser assembly 200 and the slide rail 360 are correspondingly connected to each other when the tray assembly 300 is mounted, and it leads to the state as shown in FIG. 6.

That is, the sliding portion 366 of the slide rail 360 is accommodated into the space between the guide rails 250 and the bottom of the dispenser assembly 200. Further, the guide rib 362 contacts with the lower surface of the dispenser assembly 200 to support the tray assembly 300.

Here, the protruded height of the slide rail 360 is lower than the protruded height of the guide rib 362, and thus, it is possible for the slide rail 360 to smoothly slide without contacting with the dispenser assembly 200.

In such a state, the tray assembly 300 is drew by the sliding movement between the guide rail 250 and the slide rail 360, when the tray assembly 300 is pulled by grabbing the knob 322 of the tray assembly 300. On the other hand, the tray assembly 300 is inserted by pushing the tray assembly 300 backward.

Meanwhile, the hooking element 380 of the tray assembly 300 and the fixture 270 are correspondingly connected to each other when the tray assembly 300 is fully inserted therein, and it leads to the fixed state as shown in FIG. 7. In such a state, the tray assembly 300 is fully inserted in the inside of the dispenser assembly 200, and therefore only the knob 322 is protruded from the front surface of the dispenser assembly 200 at a predetermined distance.

In this state, the hooking element 380 prevents the tray assembly 300 from being derailed from the dispenser assembly 200, as it is fastened onto the fixture 270. Further, if the knob 322 is strongly pulled toward the front to draw and remove the tray assembly 300, the tray assembly 300 is drew as the fastening is released due to the elastic deformation between the hooking element 380 and the fixture 270. Furthermore, the hooking element 380 is fastened onto the limiter 260 when the tray assembly 300 is drew at a predetermined length. Therefore, the tray assembly 300 is not allowed to be pulled any more.

Here, the limitation on the draw distance of the tray assembly 300 prevents the tray assembly 300 from being derailed due to excessive draw and prevents the vessel from being dropped to the bottom. Further, this prohibits the tray assembly 300 from further being drew unless a force is applied to the hooking element 380 to pass over the limiter 260.

Meanwhile, if the user pull the tray assembly 300 to clean the tray assembly 300, the tray assembly 300 is slid out of the dispenser assembly 200 until it is completely removed from the dispenser assembly 200.

Also, after removing the tray assembly 300, it is possible to separate the tray cover 340 from the tray body 320 by inserting the user's finger into the knob hole 344. Further, the remaining water in the remaining water storage 324 of the tray body 320 is taken out by rolling over the tray body 320.

After finishing the drainage of the remaining water, the tray cover 340 is re-mounted on the seating portion 326 of the tray body 320, and the slide rail 360 of the tray assembly 300 is inserted into the guide rail 250 of the dispenser assembly 200, and then the tray assembly 300 is fully inserted therein.

Meanwhile, if the vessel for filling the purified water or ice at the dispenser assembly 200 is small, the tray assembly 300 is fully inserted and the vessel is put thereon, as shown in FIG. 8. However, if the vessel is bigger than the bottom area of the tray body 320, the tray assembly 300 is slid out toward the front to obtain sufficient area for seating the vessel and then the vessel is put thereon, as shown in FIG. 9.

In this state, the user executes the desired process by operating the dispensing button 230 or the dispensing switch 240 of the dispenser assembly 200.

Figure 10:
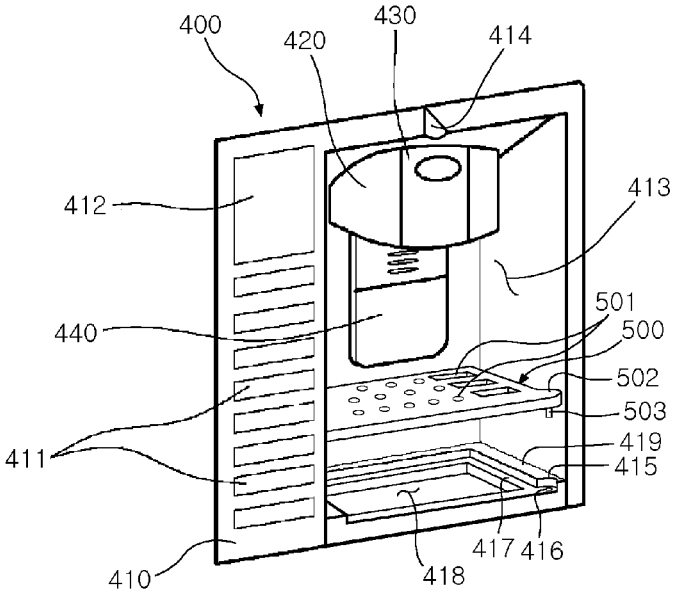
FIG. 10 is an exploded perspective view showing a structure of a dispenser assembly according to another embodiment of the present invention.
Figure 11:
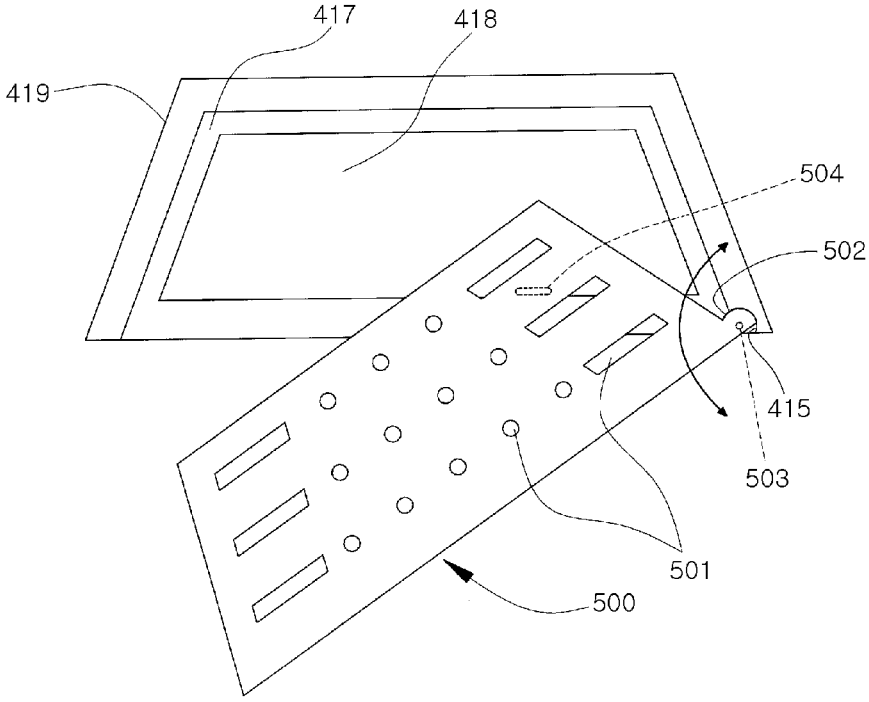
FIG. 11 is a state diagram showing operational procedure of a dispenser assembly according to another embodiment of the present invention.

FIG. 10 shows a structure of a dispenser assembly according to another embodiment of the present invention, and FIG. 11 shows a tray operational process of a dispenser assembly according to another embodiment of the present invention.

Referring to FIGS. 10 and 11, the dispenser assembly 400 has a difference in the structure of the tray and anything else is the same as the structure in FIG. 2. Therefore, the same part as shown in FIG. 2 will not be explained in detail.

Particularly, the dispenser assembly 400 according to an embodiment of the present invention includes a dispenser housing 410, an ice chute 420, a dispensing button 430, a dispensing switch 440, an operating button 411, a display 412, a vessel-receiving recess 413 and a water-dispensing hole 414. Further, a tray 500 is seated on a bottom surface 419 of the dispenser housing 410.

More particularly, a tray seating portion 417 for seating the tray 500 is formed with a step at a predetermined depth on the bottom surface 419. Further, the bottom surface 419 and the upper surface of the tray 500 are at the same level when the tray 500 is seated thereon, since the tray seating portion is formed to have a step corresponding to a thickness of the tray 500.

Also, a remaining water storage 418, in which the remaining water is stored, is formed with a predetermined depth on the inner side of the tray seating portion 417. Further, a hinge hole 416 is formed on one side edge of the tray seating portion 417, and an interference preventing portion 415 is formed around the hinge hole 416. Particularly, the interference preventing portion 415 is roundly formed at a predetermined curvature around the hinge hole 416, and thus, it serves to prevent the tray 500 from interfering with a pivoting piece 502.

Meanwhile, a plurality of through-holes 501 are formed in the tray 500, and therefore they collect the water dropped from the tray 500 into the remaining water storage 418. Further, the pivoting piece 502 protrudes from one side edge of the tray 500, and a hinge projection 503 extends on the lower surface of the pivoting piece 502. Particularly, the hinge projection 503 is inserted into the hinge hole 416, and the pivoting piece 502 is fitted into the interference preventing portion 415. Therefore, the pivoting piece 502 rotates along the interference preventing portion 415 when the tray 500 rotates around the hinge projection 503. Accordingly, the tray 500 smoothly rotates without interfering with the bottom of the dispenser housing 410.

Here, the tray 500 has a tapered shape, which decreases continuously from the front end to the rear end, in order to prevent the tray 500 from being interfered with the inner-circumferential surface of the dispenser housing 410 while rotating. Therefore, it is preferable that the edge of the tray, which is opposite to the region where the hinge projection is formed, is tapered toward the rear or roundly formed at a predetermined curvature.

Also, a stopper 504 which is protruded to the inside of the remaining water storage 418 is formed on one side of the lower surface of the tray 500. Particularly, the stopper 504 serves to limit the rotation of the tray 500 as it is interfered with one side of the front end of the remaining water storage 418.

Hereinafter, the operational procedure of the tray structure will be described.

As shown in FIG. 11, the tray 500 is rotated to the front when the user uses the vessel having a cross sectional area greater than the bottom area of the vessel-receiving recess 413. Accordingly, the tray 500 protrudes to the front of the refrigerator door. In this state, some rear part of the vessel is supported by the bottom of the dispenser housing 410, and some front part of the vessel is supported by the tray 500.

Figure 12:
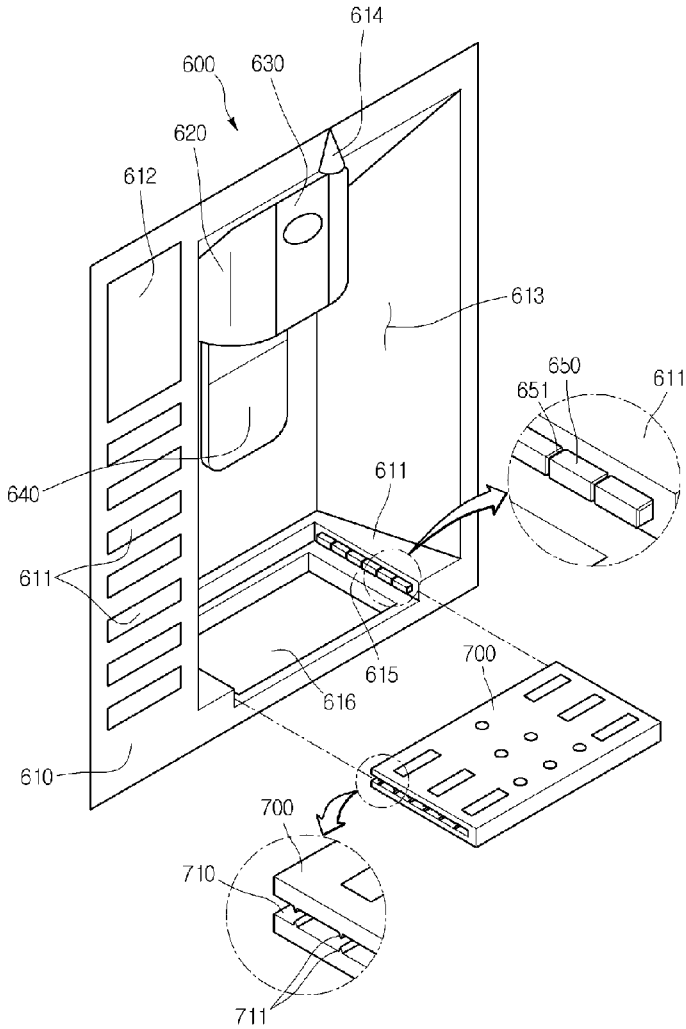
FIG. 12 is an exploded perspective view showing a structure of dispenser assembly according to further another embodiment of the present invention.

FIG. 12 shows a structure of a dispenser assembly according to further another embodiment of the present invention.

Referring to FIG. 12, the structure of the dispenser assembly according to further another embodiment of the present invention has a difference in the tray 700 is slid out of the dispenser housing 610 and anything else is the same as the structure in FIG. 2. Therefore, the same part as shown in FIG. 2 will not be explained.

Particularly, the dispenser assembly 600 according to the present invention includes a dispenser housing 610, an ice chute 620, a dispensing button 630, a dispensing switch 640, an operating button 611, a display 612, a vessel-receiving recess 613 and a water-dispensing hole 614. Further, the tray 700 is seated on the bottom surface 619 of the dispenser housing 610.

Also, a tray seating portion 615 is formed with a step at a predetermined depth on the bottom surface of the dispenser housing 610, and the step of the tray seating portion 615 corresponds to the thickness of the tray 600. Further, a remaining water storage 616 for collecting the remaining water is depressed at a predetermined depth in the inside of the tray seating portion 615.

Meanwhile, a guide rib 650 protrudes on both sides of the tray seating portion 615 and extends in the front/back direction. Further, a plurality of fastening recesses 651 are formed at a predetermined distance on the surface of the guide rib 650. Furthermore, a guide slit 710 for inserting the guide rib 650 therein is formed on both sides of the tray 700. Therefore, the tray 700 is guided in the front/back direction as it slides along the guide rib 650. And, a plurality of fastening projections 711 are formed at a predetermined distance on the upper/lower surfaces of the guide slit 710.

Here, the distance between the pair of fastening projections 711 is the same as the distance between the pair of fastening recesses 651. And then, the fastening projections 711 are inserted into the fastening recesses 651 in a state that the tray 700 is drew or inserted at a predetermined length. Further, the tray 700 is gradually drew or inserted at intervals of a distance of the fastening projections 711 and the fastening recesses 651. Furthermore, the tray 700 may be fully separated from the dispenser housing 610 when the tray 700 is kept being pulled out.

According to the above structure, the user can appropriately control the draw length of the tray 700 depending on the size of the vessel for filling the water or ice. Also, the tray 700 can stably support the vessel as the fastening projections 711 are inserted into the fastening recesses 651. Here, the positions of the guide rib 650 and the guide slit 710 may be changed. That is, the guide rib 650 may be formed on both sides of the tray 700, and the guide slit 710 may be formed on both sides of tray seating portion 615.

Figure 13:
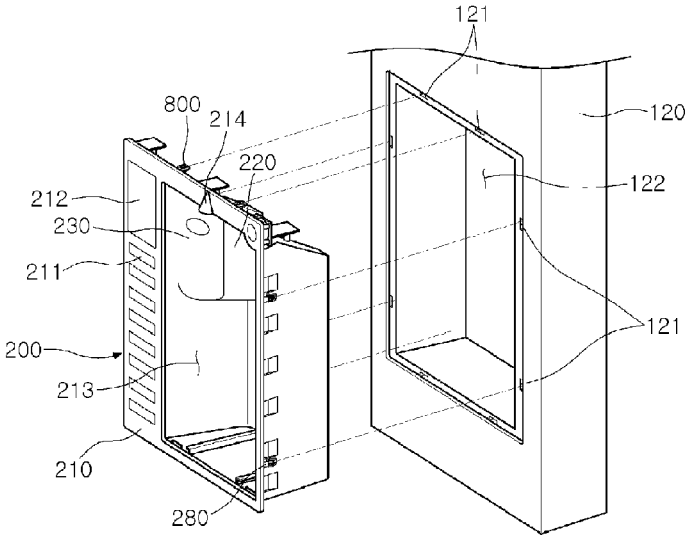
FIG. 13 is an exploded perspective view showing a dispenser assembly attached to a door according to further another embodiment of the present invention.

FIG. 13 shows a dispenser assembly which is mounted on a door according to an embodiment of the present invention.

Referring to FIG. 13, the dispenser assembly 200 according to an embodiment of the present invention is made of a plastic injection and it is mounted on the refrigerator door 120 via the fastening element.

Particularly, according to the embodiment of the present invention, the fastening element for preventing the dispenser assembly 200, in particular the dispenser housing 210 made by plastic injection from being damaged by the engagement element is provided.

Here, the same part as shown in FIG. 2 of the dispenser housing will not be explained.

A plurality of fastening projections 281, which protrude to the rear, are formed on the front edge of the dispenser housing 210. Further, another engagement element 800 is connected to the fastening projections 281, and the engagement element 800 is inserted into an engagement hole 121 formed in the front surface of the door 120.

Particularly, a dispenser seating portion 122 for inserting the dispenser assembly 200 is depressed in the front surface of the door 120 at a predetermined depth. Further, a plurality of engagement holes 121 are arranged at a predetermined distance on the edge portions of the space.

Figure 14:
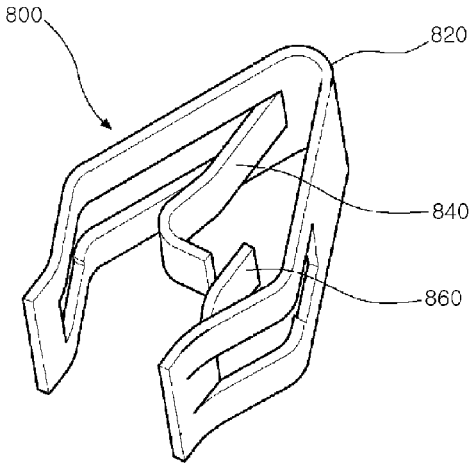
FIG. 14 is a perspective view showing an engagement element according to an embodiment of the present invention.

FIG. 14 shows an engagement element according to an embodiment of the present invention.

Referring to FIG. 14, the engagement element 800, which is provided to mount the dispenser assembly 200 on the door, according to an embodiment of the present invention includes a main body portion 820 in which a metallic board is bent as a "V" profile, an insertion portion 840 which is incised from the curved region of the main body portion 820 to some point of one side end and bent inwardly, and a support portion 860 which is incised from some point of the other side end to the curved region of the main body portion 820 and bent inwardly.

Particularly, the insertion portion 840 is bent at an angle of almost 90 degrees at the end, and inserted into a fastening hole 281, which is to be explained in the following. Further, the support portion 860 serves to maintain the main body portion 820 to be fixedly inserted in the engagement hole 121 as it is closely adhered to the surface of the fastening projection 280. This will be explained in more detail with reference to the drawings.

Figure 15:
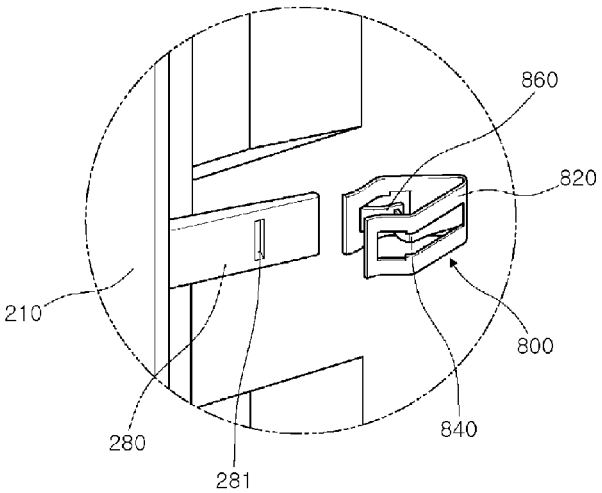
FIG. 15 is an exploded perspective view showing an engagement element before being attached to an engagement projection according to an embodiment of the present invention.
Figure 16:
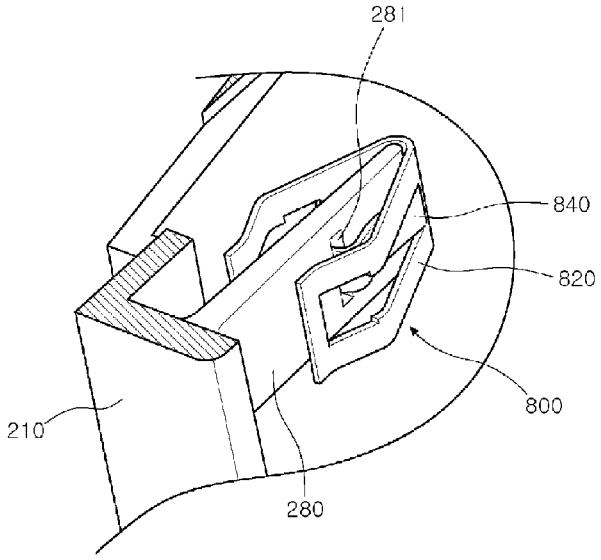
FIG. 16 is an assembled perspective view showing an engagement element attached to an engagement projection.
Figure 17:
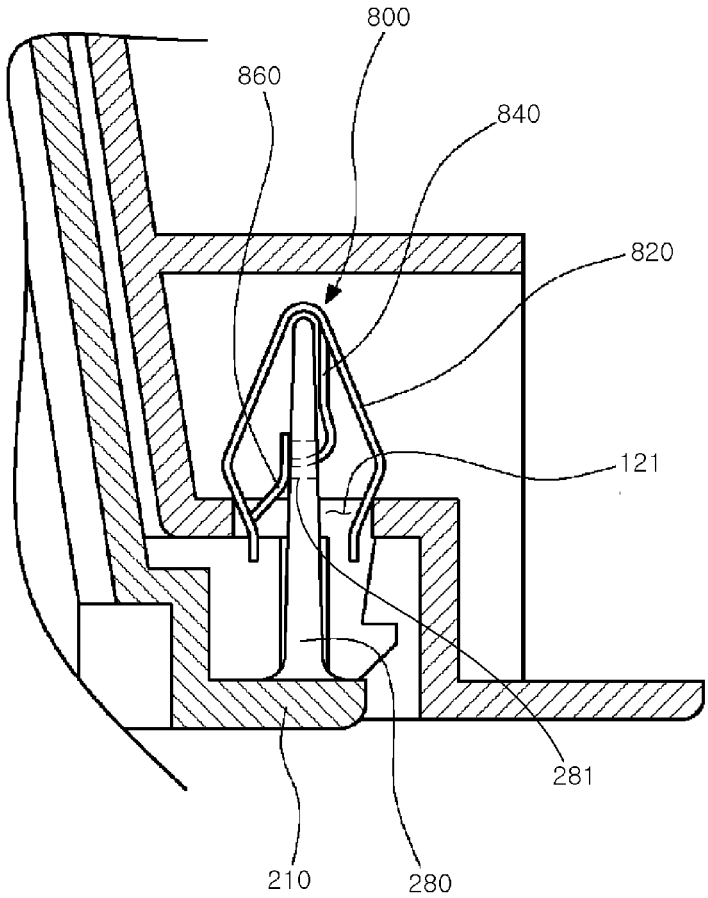
FIG. 17 is a lateral cross-sectional view showing a state of an engagement element where a dispenser assembly is attached to a door.

FIG. 15 shows an engagement element before being inserted into an engagement projection, FIG. 16 shows an engagement element coupled to an engagement projection, and FIG. 17 shows an engagement element where a dispenser assembly is mounted on a door.

Referring to FIGS. 15 to 17, a fastening hole 281 is formed in the fastening projection 280 which is protruded on the edge portion of the dispenser housing 210 of the dispenser assembly 200 in a backward direction. Further, the bent portion of the insertion portion 840 of the engagement element 800 is inserted into the fastening hole 281. Further, the portion, in which the insertion portion 840 is interfered and inserted, may be in the form of a hole as shown in the drawing or a slit with a predetermined depth.

Here, the fastening projection 280 is formed to have a thickness which is getting thicker from the lower end toward the top end. Therefore, if the fastening projection 280 is inserted between the insertion portion 840 and the support portion 860 of the engagement element 800 and pushed therein, and thus, the main body portion 820 is split. And, if the insertion portion 840 is inserted in the fastening hole 281, then the main body portion 820 is elastically restored and the engagement element 800 is not removed therefrom by the support portion 860.

Meanwhile, the plurality of fastening projections 280 are formed on the rear surface edge of the dispenser housing 210 at a predetermined distance, and therefore all engagement element 800 are mounted on the plurality of fastening projections 280, as shown in FIG. 13.

As described in the above, the engagement element 800 is inserted into the dispenser seating portion 122 formed on the door 120 where the engagement element 800 is mounted on each fastening projection 280. In the meantime, this engagement element 800 is inserted into the engagement hole 121 formed in the edge of the dispenser seating portion 122.

Here, the main body portion 820 of the engagement element 800 is curved as a "V" profile, and is split apart toward the end. Further, at certain point, the width of it becomes narrow.

According to the profile characteristic, the width of the main body portion 820 of the engagement element 800 is narrowed, since the main body portion 820 is elastically compressed as it is inserted in to the engagement hole 121. Further, the main body portion 820 is exactly fitted in the engagement hole 121 when the main body portion 820 is inserted to a point that the width is narrowed. However, in such a state, the main body portion 820 is not completely restored to initial state, but the elastically compressed state of a certain degree is maintained. This is because the width of the engagement hole 121 is smaller than the maximum width of the main body portion 820. Therefore, the insertion portion 840 is maintained to be fully inserted in the fastening hole 281, and the support portion 860 is maintained to be fixedly adhered to the surface of the fastening projection 280. Accordingly, the engagement element 800 maintains the connection as shown in FIG. 17.

INDUSTRIAL APPLICABILITY

The industrial applicability is extremely high, because the assembly process is simplified and the limitation on the vessel is reduced due to the dispenser assembly and the tray assembly structures according to the embodiments of the present invention.

The invention claimed is:

1. A refrigerator, comprising:

a main body in which a cold air storage is provided;

a door connected to the main body;

a dispenser assembly mounted on the door, the dispenser assembly comprising a housing having a bottom wall and an upper wall on which an ice chute is installed;

a tray assembly selectively coupled to the dispenser assembly and configured to be drawn out of the dispenser assembly in a front direction, the tray assembly including a tray body seated on the bottom wall of the housing and having a remaining water storage therein and a tray cover in which an opening for draining water is formed, the tray cover having a horizontal surface and a plurality of through-holes formed at the horizontal surface;

a plurality of first rail members provided at both sides of a bottom surface of the tray body, the first rail members frontwardly extended from a rear end of the tray body;

a plurality of second rail members protruded from the bottom wall of the housing to be fitted with the first rail members and configured to guide movement of the first rail members;

a hooking member provided at a rear portion of the bottom surface of the tray body;

a fixture provided at the bottom wall of the housing to be hooked to the hooking member;

a limiter provided at a portion of the bottom wall of the housing spaced apart from the fixture, and wherein the hooking member engages the fixture when the tray body is in a first position and engages the limiter when the tray body is moved to a second position.

2. The refrigerator according to claim 1, wherein the tray assembly is configured to be drawn until it is fully drawn from the dispenser assembly.

3. The refrigerator according to claim 1, further comprising:

an engagement projection protruded from one side of the dispenser assembly;

an engagement hole formed in the door and receiving the engagement projection; and an engagement element inserted into the engagement hole at a state that the engagement element is hooked to the engagement projection.

4. The refrigerator according to claim 3, wherein the engagement element is an elastic element having a shape which is bent at least one time.

5. The refrigerator according to claim 3, wherein a hole or recess, in which the engagement element is hooked, is formed in the engagement projection.

6. The refrigerator according to claim 1, wherein the tray cover is detachably coupled to the tray body.

7. The refrigerator according to claim 1, wherein the tray cover is provided with a knob hole.

8. The refrigerator according to claim 1, wherein the opening is shaped as a slit or a round hole.

9. The refrigerator according to claim 1, wherein the tray cover is provided with a knob at the front surface.

10. The refrigerator according to claim 1, further comprising a seating portion for seating the tray cover on an upper surface of the tray body, the seating portion formed with a depth corresponding to a thickness of the tray cover.

11. The refrigerator according to claim 1, wherein the tray body and the tray cover are made of different materials.

* * * * *